US005117792A

United States Patent [19]

Kanno

[11] Patent Number: 5,117,792

[45] Date of Patent: Jun. 2, 1992

[54] OVERRUN PREVENTING DEVICE FOR MULTI-CYLINDER ENGINE

[75] Inventor: Isao Kanno, Hamamatsu, Japan

[73] Assignee: Sanshin Kogyo Kabushiki Kaisha, Hamamatsu, Japan

[21] Appl. No.: 559,291

[22] Filed: Jul. 30, 1990

[30] Foreign Application Priority Data

Jul. 31, 1989 [JP] Japan ..... 1-196949

[51] Int. Cl.[5] ..... F02D 17/02

[52] U.S. Cl. ..... 123/335; 123/198 F

[58] Field of Search ..... 123/198 F, 198 DC, 198 D, 123/333, 335, 481

[56] References Cited

U.S. PATENT DOCUMENTS

| | | | |
|---|---|---|---|
| 4,336,778 | 6/1982 | Howard | 123/198 DC |
| 4,404,940 | 9/1983 | Sieja | 123/335 |
| 4,462,356 | 7/1984 | Hirt | 123/335 |
| 4,492,197 | 1/1985 | Yamamoto et al. | 123/198 DC |
| 4,638,781 | 1/1987 | Shiki et al. | 123/333 |
| 4,736,719 | 4/1988 | Framcia et al. | 123/333 |
| 4,768,474 | 9/1988 | Fujimoto et al. | 123/198 F |
| 4,883,033 | 11/1989 | Hosoe et al. | 123/334 |
| 4,977,877 | 12/1990 | Dykstra | 123/335 |

FOREIGN PATENT DOCUMENTS

| | | | |
|---|---|---|---|
| 0063368 | 4/1984 | Japan | 123/335 |

*Primary Examiner*—Tony M. Argenbright

*Attorney, Agent, or Firm*—Ernest A. Beutler

[57] ABSTRACT

An overrun preventing device is disclosed which selectively causes misfires to occur in one, two or three cylinders of a six cylinder internal combustion engine based on the detected engine speed. This overrun preventing device operates to prevent the ignition plugs from getting wet with fuel so that after a misfire has occurred in one or more of the cylinders, those cylinders can be easily reignited if desired.

4 Claims, 2 Drawing Sheets

OVERRUN PREVENTING DEVICE FOR MULTI-CYLINDER ENGINE

BACKGROUND OF THE INVENTION

This invention relates to a device for preventing engine overrunning in a multi-cylinder internal combustion engine, and more particularly to an improved arrangement for inducing misfires in one or more cylinders of a multi-cylinder engine based on the detected speed of the engine.

Various devices have been proposed for preventing multi-cylinder engines from overrunning. In such devices, if the engine speed exceeds a pre-set limit, misfires are caused to occur in specific cylinders in order to lower the engine speed. With these devices, however, the ignition plugs of the cylinders tend to get wet with fuel since the misfires are always induced in the same specified cylinders. This can make it difficult to resume ignition in these cylinders after the engine speed has dropped, and can result in irregular running of the engine. In addition, with this type of arrangement the ignition plugs can become contaminated with carbon which can cause deterioration of the plugs and a shortened life span.

It is, therefore, a principal object of this invention to provide an improved overrun preventing device for a multi-cylinder internal combustion engine which causes misfires to occur in the cylinders in a random fashion or in a sequential order as often as is necessary, but which prevents the ignition plugs from getting wet with fuel so that later reignition can easily be attained if desired.

It is a further object of this invention to provide an improved overrun preventing device for a multi-cylinder engine which prevents the ignition plugs from being deteriorated by contaminating carbon.

SUMMARY OF THE INVENTION

A first feature of this invention comprises an overrun preventing device which is adapted to be embodied in an internal combustion engine having a plurality of cylinders and ignition plugs. An engine speed detector is provided for detecting the engine speed. A main ignition timing circuit is also provided which causes misfires to occur in one or more of the cylinders based on a comparison between the detected engine speed and at least one preset engine speed so as to prevent the ignition plugs in each of the cylinders where a misfire has occurred from getting wet with fuel so that those cylinders can be easily reignited. The misfires can be caused to occur in a random fashion or in a sequential order.

A second feature of this invention is adapted to be embodied in a method for operating an internal combustion engine having a plurality of cylinders and ignition plugs comprising the steps of detecting the engine speed and causing misfires to occur in one or more of the cylinders based on a comparison between the detected engine speed and at least one preset engine speed so as to prevent the ignition plugs in each of the cylinders where a misfire has occurred from getting wet with fuel so that those cylinders can be easily reignited. As in the first feature, the misfires can be caused to occur in a random fashion or in a sequential order.

DETAILED DESCRIPTION OF THE PREFERRED EMBODIMENTS OF THE INVENTION

Figure 1:
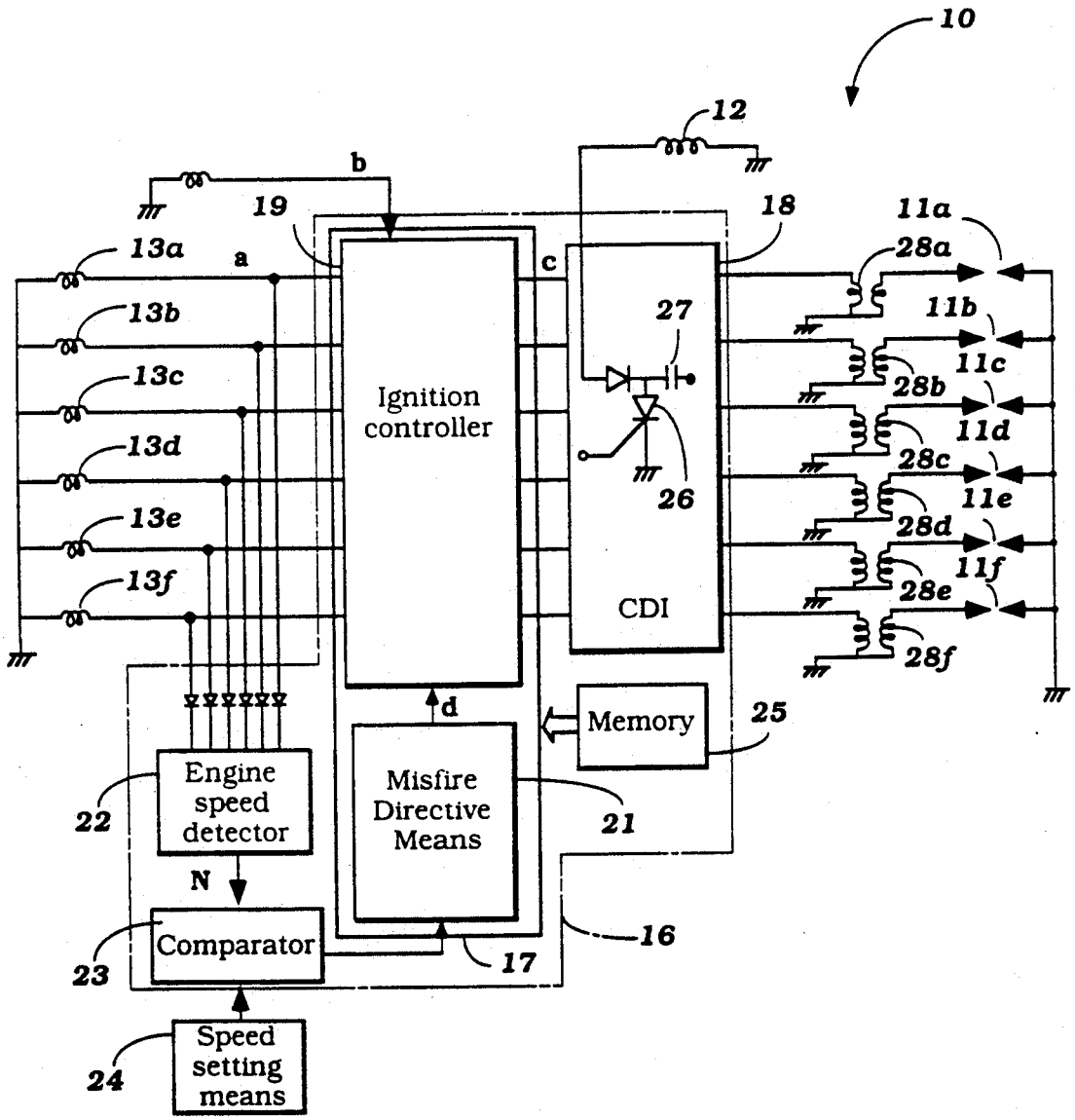
FIG. 1 is a schematic diagram showing the overrun preventing device for use in connection with a multi-cylinder internal combustion engine.

Referring now in detail to the drawings and initially to FIG. 1, an overrun preventing device for a multi-cylinder engine constructed in accordance with this invention is identified generally by the reference numeral 10. The overrun preventing device 10 is adapted to be embodied in a multi-cylinder internal combustion engine and may be employed in conjunction with a wide variety of engines of that type.

The engine in the illustrated embodiment is of the six cylinder type and includes six individual cylinder bores that slidably support pistons that are connected by means of connecting rods to a crankshaft for providing output power from the engine.

In one type of engine, a fuel/air charge is delivered to sealed crankcase chambers associated with each of the cylinder bores by means of a suitable charge former such as individual carburetor barrels that draw air from an air inlet device and deliver it to the crankcase chambers through an intake manifold. Throttle valves are positioned in the individual carburetor barrels for controlling the flow of the fuel/air mixture thereto in a known manner. The throttle valves are all operated in sequence by means of a throttle valve linkage that is controlled by a remotely positioned operator through a bowden wire actuator.

The fuel/air charge which is delivered to the individual crankcase chambers associated with the cylinder bores is transferred to the area above the pistons during the downward movement of the pistons through suitable scavenge passages. This charge is then fired in the combustion chambers by means of individual spark plugs 11*a* through 11*f* and exhausted from exhaust ports.

The spark plugs 11*a* through 11*f* are fired from an ignition system which preferably includes a magneto generator assembly which is associated with a flywheel that is affixed for rotation with the crankshaft. The magneto generator preferably includes a series of permanent magnets that are affixed to the flywheel and which cooperate which a charging coil 12 for generating a charging current in the coil during rotation of the flywheel. In addition, there is provided a plurality of pulser coils 13*a* through 13*f* that cooperate with further magnets for generating individual timing pulses when the pistons associated with the individual cylinders are at an appropriate position. On pulser coil is associated with each of the cylinders and spark plugs.

The individual signals from the pulser coils 13*a* through 13*f* are transmitted to an ignition control circuit shown schematically and outlined in phantom at 16 which includes a main ignition timing circuit 17 and a capacitor discharge ignition (CDI) circuit 18.

This main ignition timing circuit 17 comprises an ignition controller 19, and misfire directive means 21 which transmits signals to the controller 19 for causing misfires to occur in one or more of the cylinders as hereinafter described. An engine speed detector 22 receives signals from each of the pulser coils 13*a* through 13*f* for determining the speed of the engine N. A signal indicative of the engine speed N is transmitted to a comparator 23 which also receives signals from a speed setting means 24. The speed setting means inputs preset engine speeds $x_1$, $x_2$, $x_3$ and $x_4$ to the comparator 23. The comparator 23 compares the detected engine speed N with the preset engine speeds and outputs signals indicative of this comparison to the main ignition timing circuit 17, where the signals are transmitted to the misfire directive means 21 and then to the ignition controller 19. The main ignition timing circuit 17 including the misfire directive means 21 interfaces with a memory unit 25 which can also be used for determining when to cause a misfire in one or more the cylinders.

The ignition controller 19 of the main ignition timing circuit 17 calculates a desired or optimum ignition timing for a given engine speed N. Ignition signals for each of the individual cylinders indicative of this calculated timing are then generated and transmitted to the CDI circuit 18 where a thyristor 26 discharges a capacitor 27 for firing the spark plugs 11*a* through 11*f* by means of individual ignition coils 28*a* through 28*f*, one associated with each of the spark plugs 11*a* through 11*f*.

In accordance with the invention, the ignition controller 19 causes misfires to occur in three of the six cylinders, or in two of the six cylinders, or in one of the six cylinders depending on the detected engine speed N. The cylinders in which the misfires are caused to occur are chosen at random based on, for example, a random number table. In the alternative, the misfires can be caused to occur in the cylinders in a sequential order based on a particular mathematical rule or equation.

Figure 2:
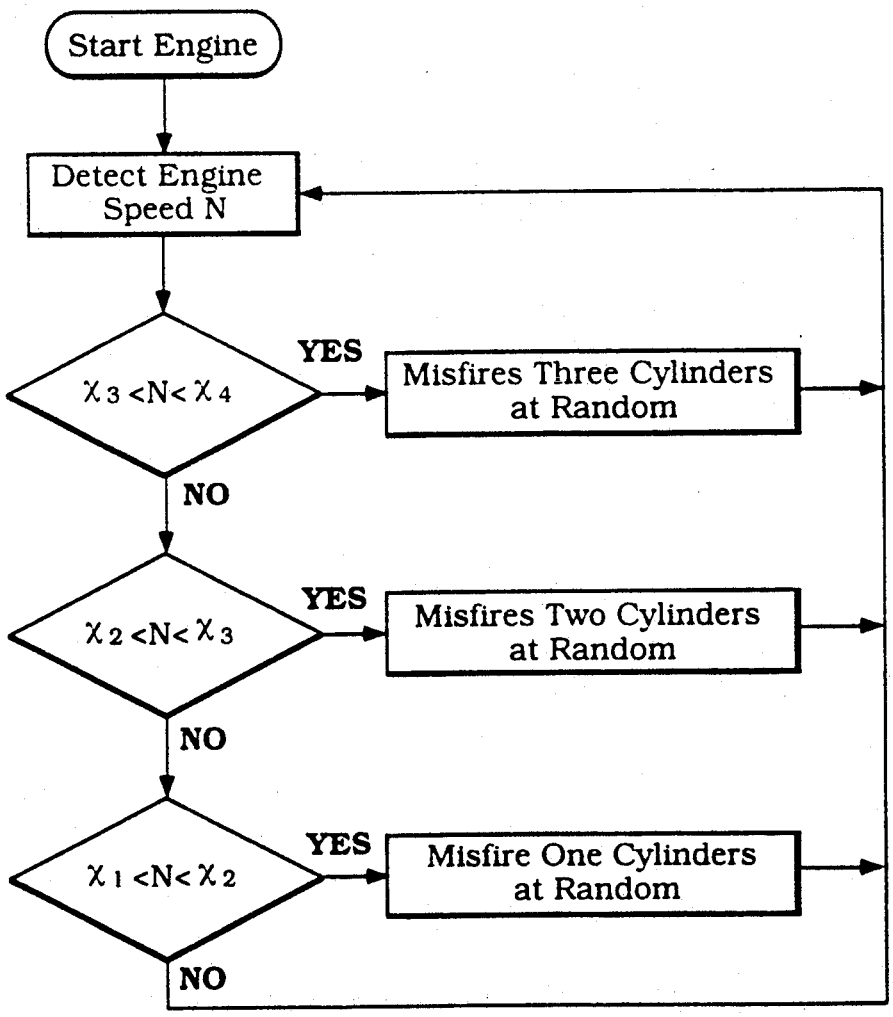
FIG. 2 is a flow chart showing the operation of the overrun preventing device.

Referring now to FIG. 2, in addition to FIG. 1, a flow chart is depicted illustrating the operation of the overrun preventing device 10. At the outset, the engine is started and the engine speed N is detected by the engine speed detector 22. This detected engine speed N is then compared by the comparator 23 against preset speeds $x_1$, $x_2$, $x_3$ and $x_4$ which are programmed into the engine speed setting means 24. When the engine speed N is between $x_3$ and $x_4$, the misfire directive means 21 transmits a misfiring signal to the ignition controller 19 to cause misfires in three randomly selected cylinders of the six cylinders. Afterward, the engine speed N is again detected. If the engine speed N is not between $x_3$ and $x_4$, it is compared against $x_2$ and $x_3$. If N is greater than $x_2$ but less than $x_3$, misfires are caused to occur in two randomly selected cylinders of the six cylinders. Afterward, the engine speed N is again detected. If the engine speed N is greater than $x_1$ but less than $x_2$, a misfire will occur in one of the six cylinders which is selected at random. In this invention, the cylinders in which the misfires occur can be selected by the misfire directive means 21 in a random manner using, for example, a mathematical means like a random numbers table. Alternatively, misfires can be programmed to occur in a specified sequential order based on a particular mathematical rule or equation.

It is to be understood that the foregoing is a description of the preferred embodiments of the invention and that various changes and modifications may be made without departing from the spirit and scope of the invention, as defined by the appended claims.

I claim:

1. An overrun preventing device for an internal combustion engine having a plurality of cylinders and ignition plugs, comprising an engine speed detector for detecting engine speed and a main ignition timing circuit for causing a misfire to occur in at least one of the cylinders selected at random based on a comparison between the detected engine speed and at least one preset engine speed so as to prevent the ignition plugs from getting wet with fuel so that the ignition plugs can be easily reignited.

2. An overrun preventing device for an internal combustion engine having six cylinders and ignition plugs, comprising an engine speed detector for detecting engine speed and a main ignition timing circuit for causing a misfire to occur in at least one of the cylinders based on a comparison between the detected engine speed and at least one preset engine speed so as to prevent the ignition plugs from getting wet with fuel so that the ignition plugs can be easily reignited, wherein, if the detected engine speed is between a first preset engine speed and a second preset engine speed, said main ignition timing circuit causes misfires to occur in three cylinders.

3. An overrun preventing device as recited in claim 2, wherein, if the detected engine speed is between the second preset engine speed and a third preset engine speed, said main ignition timing circuit causes misfires to occur in two cylinders.

4. An overrun preventing device as recited in claim 3, wherein, if the detected engine speed is between the third preset engine speed and a fourth preset engine speed, said main ignition timing circuit causes a misfire to occur in one cylinder.

* * * * *